US007313843B2

(12) United States Patent
Brinker et al.

(10) Patent No.: US 7,313,843 B2
(45) Date of Patent: Jan. 1, 2008

(54) MOP WITH DISPOSABLE CLEANING ELEMENT

(75) Inventors: Jane Brinker, 51 W. 16th St., New York, NY (US) 10011; Frank Verona, Bradenton, FL (US)

(73) Assignee: Jane Brinker, New York, NY (US)

( * ) Notice: Subject to any disclaimer, the term of this patent is extended or adjusted under 35 U.S.C. 154(b) by 428 days.

(21) Appl. No.: 10/492,882

(22) PCT Filed: Dec. 21, 2001

(86) PCT No.: PCT/GB01/05738

§ 371 (c)(1),
(2), (4) Date: Sep. 30, 2004

(87) PCT Pub. No.: WO03/032800

PCT Pub. Date: Apr. 24, 2003

(65) Prior Publication Data

US 2005/0039286 A1 Feb. 24, 2005

Related U.S. Application Data

(60) Provisional application No. 60/330,302, filed on Oct. 19, 2001.

(51) Int. Cl.
*B25G 3/24* (2006.01)
*A47L 13/20* (2006.01)

(52) U.S. Cl. ..... 15/228; 15/147.1; 15/145

(58) Field of Classification Search ..... 15/228, 15/147.1, 145
See application file for complete search history.

(56) References Cited

U.S. PATENT DOCUMENTS 2,256,299 A * 9/1941 Thompson ..... 15/150
2,724,852 A 11/1955 Clarki (Continued)

FOREIGN PATENT DOCUMENTS

CA 2206730 12/1997

(Continued)

OTHER PUBLICATIONS

Socket. http://dictionary.reference.com/browse/socket. Jan. 31, 2007.*

(Continued)

*Primary Examiner*—Shay L. Karls
(74) *Attorney, Agent, or Firm*—Ostrolenk, Faber, Gerb & Soffen, LLP

(57) ABSTRACT

A mop construction comprises an elongate shaft (3) and a mop head (4) arranged on a first end of the shaft, wherein the mop head has a clamp mechanism (103). A discardable substantially rigid cleaning member (50) is selectively engageable by the clamp mechanism (34, 35) and an operating arrangement (9) for opening and closing the clamp mechanism is provided to allow the cleaning member (50) to automatically separate from and couple to the clamp mechanism (22) respectively.

20 Claims, 6 Drawing Sheets

U.S. PATENT DOCUMENTS

| | | | | | |
|---|---|---|---|---|---|
| 2,864,110 | A | * | 12/1958 | Bruger | 15/144.4 |
| 4,031,673 | A | * | 6/1977 | Hagelberg | 451/517 |
| 4,407,039 | A | * | 10/1983 | Moss | 15/144.2 |
| 5,455,980 | A | * | 10/1995 | Buchanan | 15/228 |
| 5,815,878 | A | | 10/1998 | Murakami et al. | |

FOREIGN PATENT DOCUMENTS

| | | | |
|---|---|---|---|
| DE | 297 17 217 | | 12/1997 |
| EP | 556539 | A1 | 8/1993 |
| EP | 811350 | A2 | 10/1997 |
| EP | 1 086 648 | | 3/2001 |
| JP | 2001 037697 | | 2/2001 |
| WO | WO 01/12052 | | 2/2001 |
| WO | WO 01/45547 | | 6/2001 |

OTHER PUBLICATIONS

International Search Report dated Oct. 10, 2002.

* cited by examiner

MOP WITH DISPOSABLE CLEANING ELEMENT

CROSS-REFERENCE TO RELATED APPLICATIONS

The present application claims priority to PCT Application No. PCT/GB01/05738, filed Dec. 21, 2001, which claims priority to Provisional Application No. 60/330,302, filed Oct. 19, 2001.

BACKGROUND OF THE INVENTION

1. Field of the Invention

The present invention generally relates to the field of hand-held mops, and more particularly to the field of mops with disposable cleaning elements.

2. Description of the Related Art

Traditional wet mops include a fibre absorptive rope head element which is used in wet rung condition and which is periodically rinsed in a bucket of soapy water and rung to semi-dry condition for reapplication to a floor or other surface. After completion of the operation, the bucket is emptied and the mop head is allowed to dry for reuse.

This task is burdensome and many attempts have been made in the prior art to simplify it. It is known in the prior art to provide a mop handle attached to a mop head to which a cleaning sheet is applied and affixed thereto by a clamping arrangement. For example, in WO01/12052 an arrangement is disclosed in which a sheet is applied over the planar cleaning surface of the mop head, wrapped around to a rear surface, and retained in four attachment structures which grip the sheet. Another arrangement disclosed in U.S. Pat. No. 5,815,878 discloses a similar arrangement in which the cleaning sheet is applied over the cleaning face of the mop head and wrapped around to a back face where it is clamped at opposed ends of the mop head by clamp members.

These arrangements have the disadvantage that it is not only burdensome to fit and remove the cleaning sheet, it also requires the user to handle the cleaning sheet. After use of the cleaning sheet, the job of removal of the dirty cleaning sheet can be messy and unpleasant for the user. This is particularly so when the mop is a wet mop and the cleaning sheet is moist or wet.

BRIEF SUMMARY OF THE INVENTION

It is an object of the present invention to provide a mop with a disposable cleaning element which overcomes the deficiencies in the prior art and allows for the mop to the used as a wet or dry mop without requiring a user to handle a cleaning sheet.

A first aspect of the present invention provides a mop construction comprising: an elongate shaft; a mop head on a first end of said shaft, said mop head having a clamp mechanism; a discardable substantially rigid cleaning member selectively engageable by said clamp mechanism; and an operating arrangement for opening and closing said clamp mechanism to allow said cleaning member to automatically separate from and couple to said clamp mechanism respectively.

A second aspect of the present invention provides a mop handle comprising: an elongate shaft; a mop head on a first end of said shaft, said mop head having a clamp mechanism for selectively engaging a discardable cleaning member; and an operating arrangement for opening and closing said clamp mechanism to allow said cleaning member to automatically separate from and couple to said clamping mechanism respectively.

A third aspect of the present invention provides a cleaning member for use with the mop handle comprising a substantially planar body, an engagement member on a first side of the body for engagement by the clamping mechanism of the mop handle; and a cleaning layer applied across a second side of said body.

Another aspect of the present invention provides a cleaning member cartridge containing a stacked plurality of the cleaning members, wherein the cleaning member container has an opening through which the mop head can be projected for engagement of the clamp mechanism with a cleaning member at the top of the stack.

A further aspect of the present invention provides a mop housing having a container for receiving the cleaning member cartridge and a lid operable to allow access to the opening of the cleaning member cartridge. The mop housing can include a mop stand comprising an engagement member for engagement by the clamp mechanism of the mop handle to stand the mop handle in the mop housing.

The present invention thus provides a mop construction in which there is no requirement for a user to handle the cleaning member. The cleaning member can be operably coupled and decoupled from the mop handle using the operating arrangement without a user having to touch the cleaning member. When the operating member is operated to open the clamp mechanism, the cleaning member automatically separates from the clamp mechanism. This enables the operating arrangement to be operated when the mop head is held above a disposal receptacle such that when the clamp mechanism is opened the cleaning member falls into the disposal receptacle.

The present invention is applicable to wet or dry mops. In one embodiment of the present invention, a supply of cleaning elements can be provided in a cartridge. The cleaning members can be ready primed with an appropriate cleaning material or solution. Where the cleaning member is primed with a solution which can dry when exposed to the atmosphere, the cartridge can be provided in the mop construction with a lid to keep the cleaning members fresh.

In one embodiment of the present invention the clamp mechanism is arranged to operate to open and close facing along an axis of the shaft away from the first end of the shaft.

In an embodiment of the present invention the clamp mechanism comprises first and second relatively movable clamp members forming jaws. A spring arrangement can be provided for urging the jaws shut and the operating arrangement is then arranged to act against the spring mechanism to allow the jaws to be opened.

In one embodiment the first and second clamp members extend substantially perpendicularly to the elongate shaft for engagement with an elongate engagement member of the cleaning member. The jaws can include an opening at each end thereof to allow the engagement member of the cleaning member to extend therethrough. This arrangement enables the cleaning member to relatively rotate in the jaws of the clamp mechanism about an axis perpendicular to the shaft. This enables the mop to be used to clean a surface whereby the angle at which the handle of the mop held relative to the surface to be cleaned conveniently varies.

In an alternative embodiment of the present invention, the clamp mechanism forms a socket-type joint for receiving an engagement member of the cleaning member to allow relative rotation of the cleaning member and the mop handle. In this embodiment of the present invention, the socket-type joint receives a projection-type engagement member thereby allowing full rotational movement about a point defined by the clamp mechanism. This allows the cleaning member to be swivelled around and does not restrict the rotation to a single axis perpendicular to the shaft.

The operating arrangement can comprise any suitable arrangement for operating the clamp mechanism. In one embodiment a lever-type mechanism is used to lever open the jaws of the clamp mechanism. The operating arrangement can thus be mounted anywhere suitable such as on the head or more preferably on the shaft. In a preferred embodiment the operating member comprises an operating lever mounted on the shaft to remotely operate the clamp mechanism of the head. This avoids the need for a user to stoop to operate the clamp mechanism. The operation of the clamp mechanism can be simply carried out by the lever provided on the shaft.

In one embodiment of the present invention the cleaning member comprises a panel, an engagement member on a first side of the panel for engagement by the clamp mechanism of the mop handle, and a cleaning layer applied across a second side of the panel.

The cleaning layer can comprise any suitable material, e.g. in sheet form such as a fibrous material, or a sponge-like material. The cleaning layer can be impregnated with any suitable cleaning material such as a liquid.

In one embodiment the engagement member has a curved surface for engagement by the clamp mechanism to allow the clamp mechanism to slide over the surface to allow relative rotation of the handle and cleaning member. Thus in this embodiment of the present invention, the engagement member is suitably shaped to allow relative rotation thereabout.

In one embodiment the panel is elongate and the engagement member extends along a first side of the panel. In such an arrangement the engagement member can comprise a substantially cylindrical rod which can extend from the first side of the panel. This enables the rod to be engaged by the jaws of the clamp mechanism to allow rotation about the axis of the rod.

In an alternative embodiment of the present invention, the engagement member comprises a protrusion from the first side of the panel which can be engaged by the clamp mechanism in the form of a socket joint to allow the relative rotation of the cleaning member and the mop handle about a pivot point formed by the protrusion. Thus in this arrangement the rotation is not restricted to a single axis perpendicular to the shaft but instead comprises any axis perpendicular to the shaft, i.e. a pivot point formed by the protrusion.

In one embodiment of the present invention the cleaning layer comprises a compliant layer of absorbent material which extends beyond the boundaries of the second side of the panel. Thus in this embodiment of the present invention, the compliant layer is able to provide a cleaning function for crevices and corners which may not be reached by the material on the panel.

In one embodiment of the present invention, the panel is sufficiently rigid to spread the force applied by the mop handle to the engagement member across the panel so as to apply substantially even pressure across the second side of the panel to a surface being mopped.

BRIEF DESCRIPTION OF THE DRAWINGS

Embodiments of the present invention will now be described with reference to the accompanying drawings in which.

DETAILED DESCRIPTION OF PREFERRED EMBODIMENT

A first embodiment of the present invention will now be described with reference to FIGS. 1 to 12. This embodiment of the present invention provides a mop construction in which a cleaning member is selectively engaged to a mop handle by a clamp mechanism which provides for relative rotation of the cleaning member and the mop handle in a direction perpendicular to the shaft of the mop handle.

Figure 1:
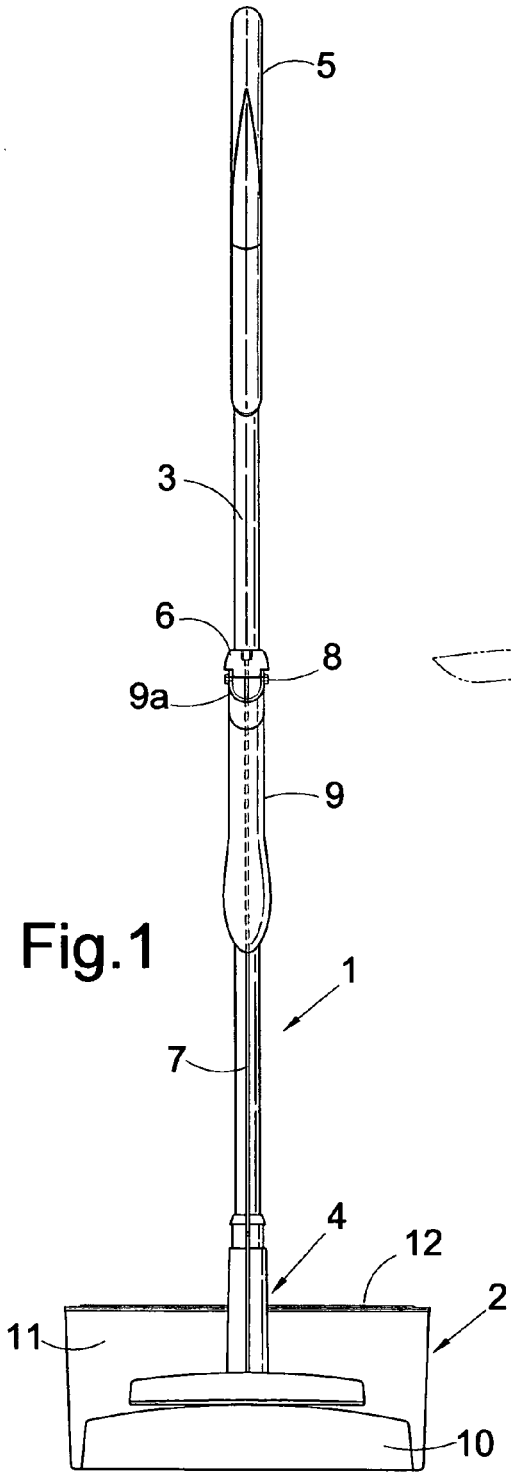
FIG. 1 is a front view of a mop construction in accordance with a first embodiment of the present invention.
Figure 2:
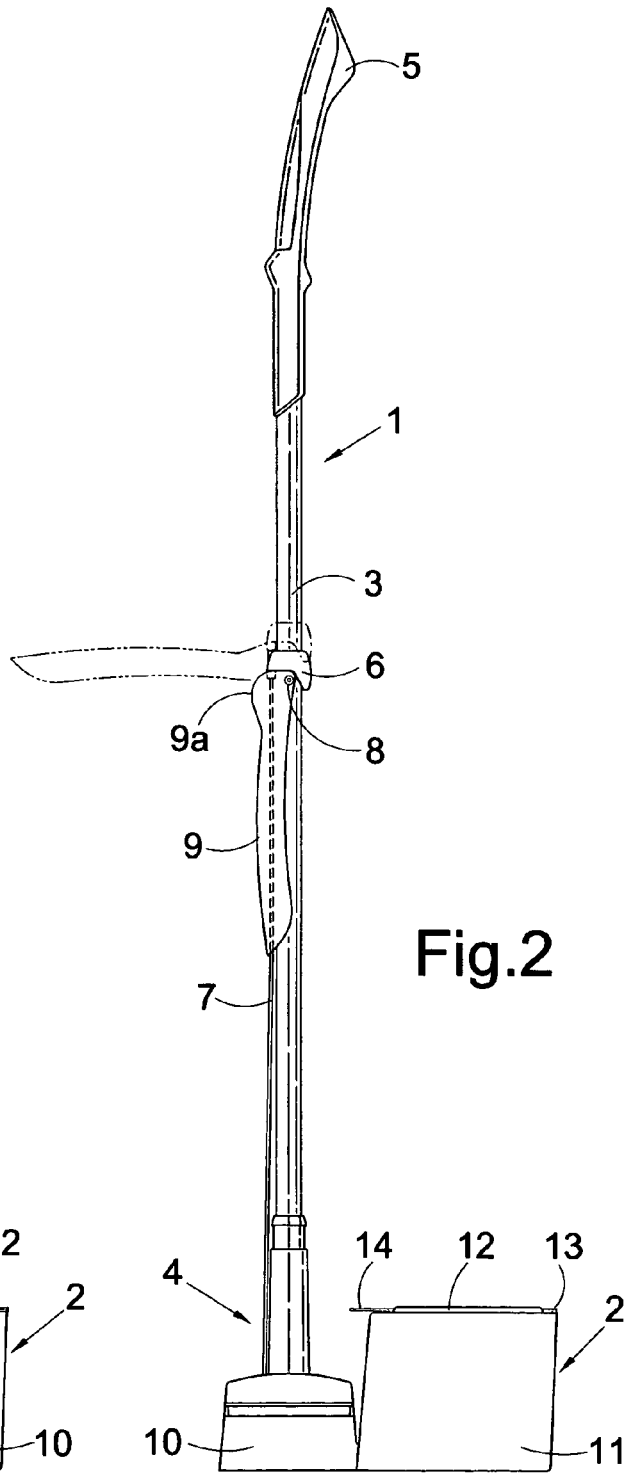
FIG. 2 is a side view of the mop construction in accordance with the first embodiment of the present invention.

Referring to FIGS. 1 and 2, the mop construction comprises a mop handle 1 positioned in a mop housing 2. The mop handle 1 comprises a mop shaft 3 having a mop head 4 mounted thereon at one end and having a hand grip 5 at a second end thereof. At a position intermediate the first and second ends, a collar 6 is provided on the shaft 3 such that the collar 6 can slide along the shaft 3. The collar 6 has a cable 7 attached thereto which extends parallel to the shaft to the mop head 4. The cable 7 is thus connected at its ends to the collar 6 and the mop head 4. Immediately below the collar 6 there is provided a handle pivot 8 which comprises a pivot pin extending through the shaft 3. A handle 9 is mounted on the handle pivot 8. The handle 9 comprises an elongate member having a recessed channel to allow it to lie along the shaft 3 covering the cable 7 when in the unoperated state. The handle 9 has a face 9*a* which is operable as a cam face to urge the collar 6 upwards along the shaft 3 when the handle 9 is operated by pivoting the handle 9 about the handle pivot 8 towards a position extending perpendicularly from the shaft 3. This action pulls the cable 7 upwards which in turn pulls the mechanism within the mop head 4 to open the clamp mechanism as will be described in more detail hereinafter.

The mop housing 2 comprises a mop stand 10 and a container 11 for containing cleaning members. The container 11 has a lid 12 pivotably attached to the container 11 by a hinge 13 and having a handle portion 14 to allow the lid 12 to be lifted and thereby pivoted about the hinge 13.

Figure 3:
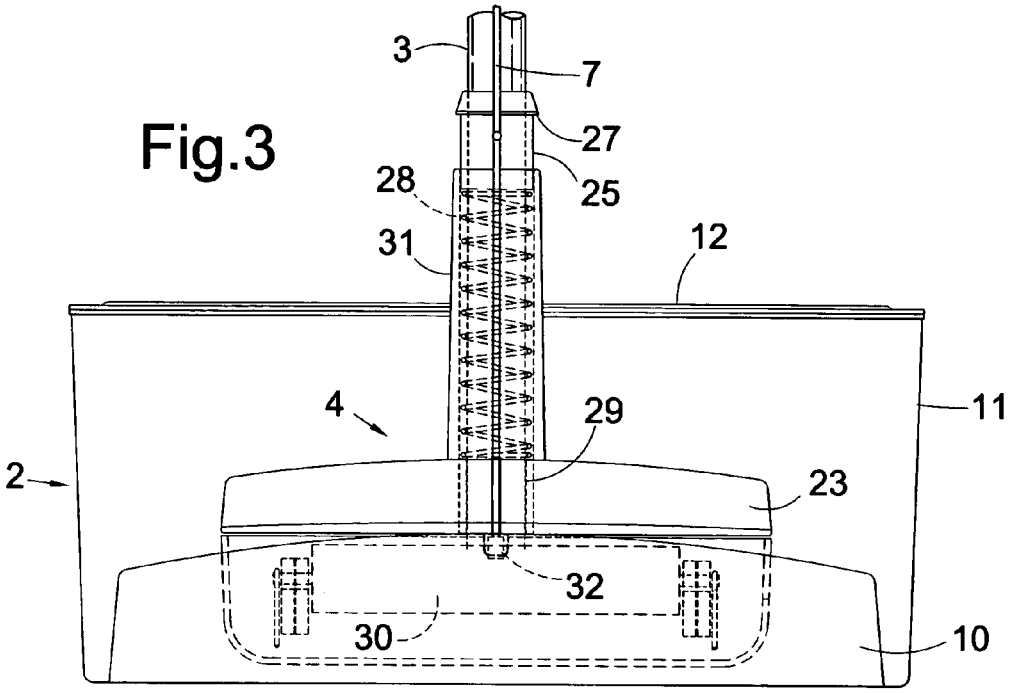
FIG. 3 is a close-up diagram of a front view of the mop housing and mop head of the first embodiment of the present invention.
Figure 4:
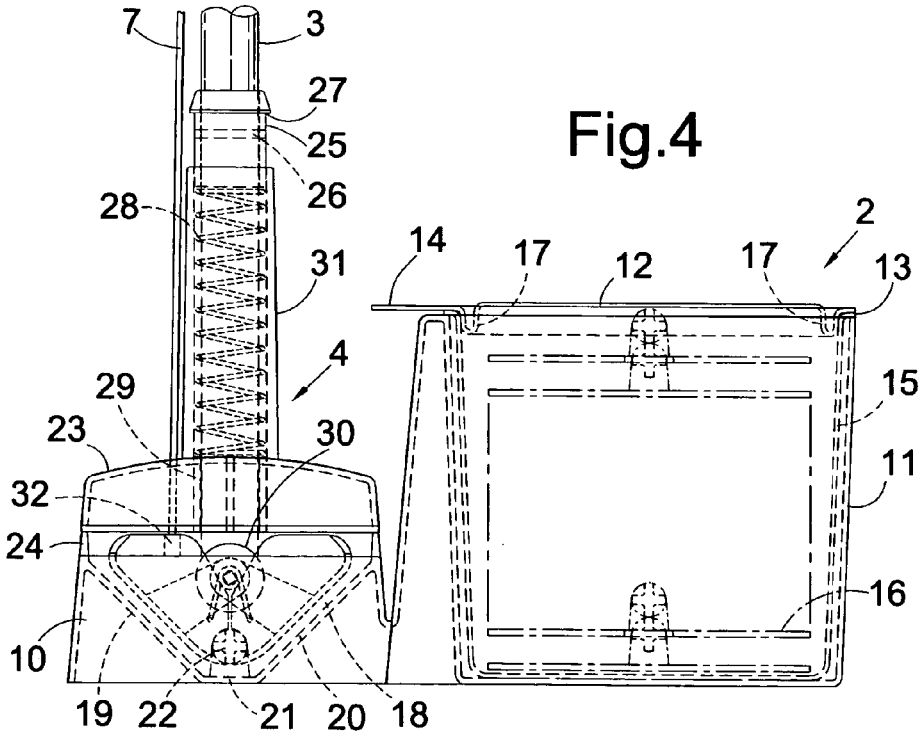
FIG. 4 is a close-up side view of the mop housing and mop head showing internal detail in accordance with the first embodiment of the present invention.

The structure of the mop head 4 and the mop housing 2 will be described in more detail with reference to FIGS. 3 and 4.

The container 11 contains a cartridge 15 of stacked cleaning elements 16. The cartridge 15 comprises a container of cleaning elements 16 which can be dropped into the container 11 when the lid 12 is open. Cartridges of this form can be purchased separately from the mop construction and are consumable items since the cleaning elements 16 are disposed of once used. Thus when the cartridge 15 is empty, a new cartridge 15 containing cleaning elements is purchased, the old empty cartridge 15 is taken out of the container 11 and disposed of, and the new cartridge 15 is placed in the container 11. The cartridge 15 includes an opening at the top thereof to allow access to the cleaning elements 16. When the cartridge 15 is purchased, or stored, the opening can be sealed by a suitable sealing member such as a frangible seal or lid. In this way cleaning elements which are impregnated with suitable cleaning materials are kept fresh and are prevented from drying out. When the new cartridge 15 is loaded into the container 11, the seal on the cartridge 15 is removed and the lid 12 of the container 11 acts to seal the cartridge 15. Sealing is provided by a ridge 17 extending down from the lid 12 to engage an inner edge of the opening in the cartridge 15.

Attached to the side of the container 11, the mop stand 10 comprises a recessed area 18 for receiving the mop head 4. The recessed area 18 is formed by providing two sloping faces 19 and 20 which slope inwardly towards a base 21 of the recessed area 18 on which is mounted an engagement member 22 for engagement by the clamp mechanism of the mop head 4. A mop head housing 23 of the mop head is arranged to rest on an upper lip of the mop stand when the clamp mechanism of the mop head 4 is engaged with the engagement member 22 of the mop stand to thereby enable the mop handle 1 to stand substantially vertically in the mop stand 10. The engagement member 22 of the mop stand 10 is substantially similar to the engagement member of a cleaning member 16 and thus this structure will be described in more detail hereinafter.

The structure of the mop head 4 and the operation of the clamp mechanism within the mop head 4 will now be described in more detail with reference to FIGS. 4, 5, 6 and 10.

At a position near the end of the shaft 3, a sleeve 25 is mounted on the shaft 3 by a pin 26. The sleeve 25 includes a shoulder 27 arranged to act as a stop to limit the movement of the mop head 4 along the shaft 3. Between the sleeve 25 and the end of the shaft 3 a helical spring 28 is provided around the shaft 3 abutting the sleeve 25 at one end and abutting the mop head housing 23 at the other end. The mop head housing 23 includes a bore 29 through which the first end of the shaft 3 projects to attach to a bar 30. The bar 30 is attached to the first end of the shaft 3 perpendicularly to the axis of the shaft. The mop head housing 23 includes a mop head sleeve 31 extending to cover the shaft 3 and the spring 28 and to slide along the sleeve 25. Thus, when the cable 7 is pulled upwards by the operation of the handle 9, since the cable is attached by cable attachment 32 to the mop head housing 23, the mop head housing 23 is urged upwards along the shaft 3 against the biasing action of the spring 28. The difference in position of the mop head housing 23 between the two positions is illustrated in FIGS. 5 and 6.

The clamp mechanism of the mop head 4 will now be described in more detail with reference to FIGS. 5, 6 and 10. Axially extending from each end of the bar 30 are jaw pivots 33. Mounted on the jaw pivots 33 are jaw members 34 and 35. The jaw members include jaw arms 36, 37, 38 and 39 to mount the jaw members 34 and 35 to the jaw pivots 33. A jaw spring 40 is mounted on one of the jaw pivots 33 and comprises spring arms that extend onto the jaw arms 38 and 39 to bias the jaw members 34 and 35 apart. The jaw members 34 and 35 each have a jaw edge 41, 42 which are arranged to contact or near contact when the clamp mechanism is closed. At each end of the jaw edges 41 and 42 the jaw members 34 and 35 have cut-away portions 43 to 46 forming a bore through which a cylindrical member of the cleaning element can extend when the clamp mechanism engages the cleaning element 16. A rear edge of the jaw members 34 and 35 includes a recess 47 to ride on a slide bar 48 mounted across the width of the mop head housing 23. Thus the jaw spring 40 urges the jaw members 34 and 35 to slide along the slide bar 48 to an open configuration when the handle 7 is operated to pull the cable 7 and hence the mop head housing 23 upwards along the shaft 3.

Figure 5:
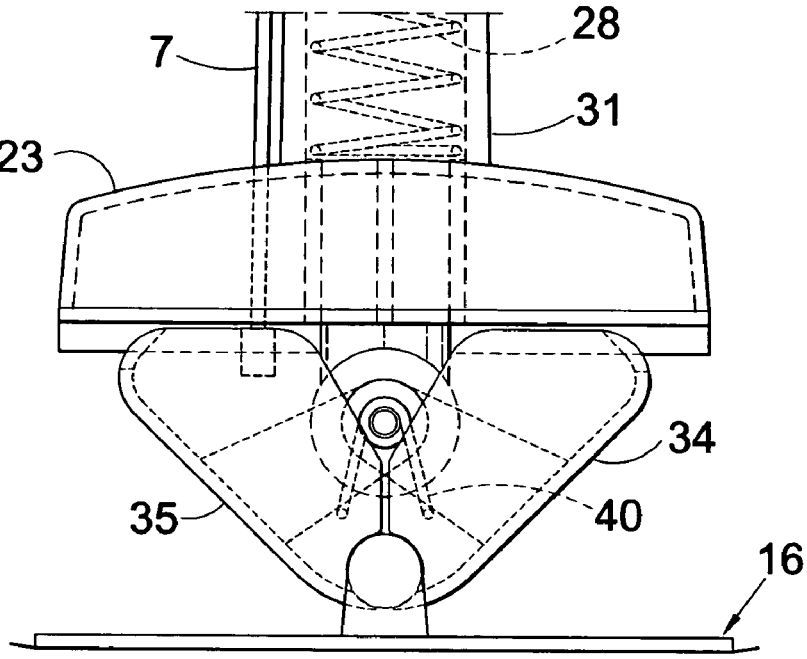
FIG. 5 is a diagram of the mop head showing engagement with the cleaning member in accordance with the first embodiment of the present invention.
Figure 6:
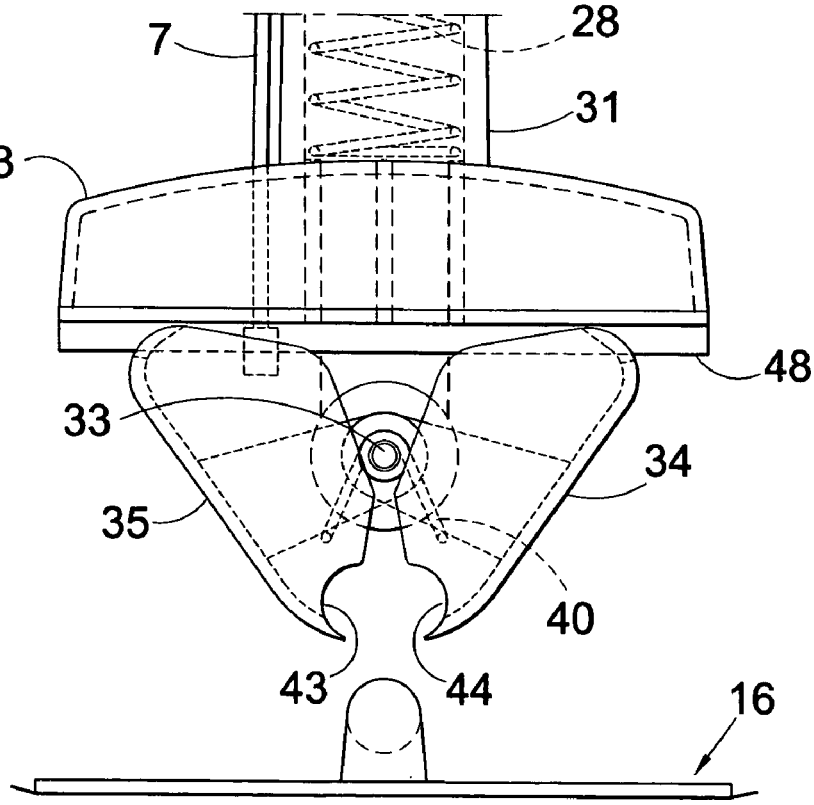
FIG. 6 is a diagram of the mop head showing disengagement from the cleaning member.
Figure 10:
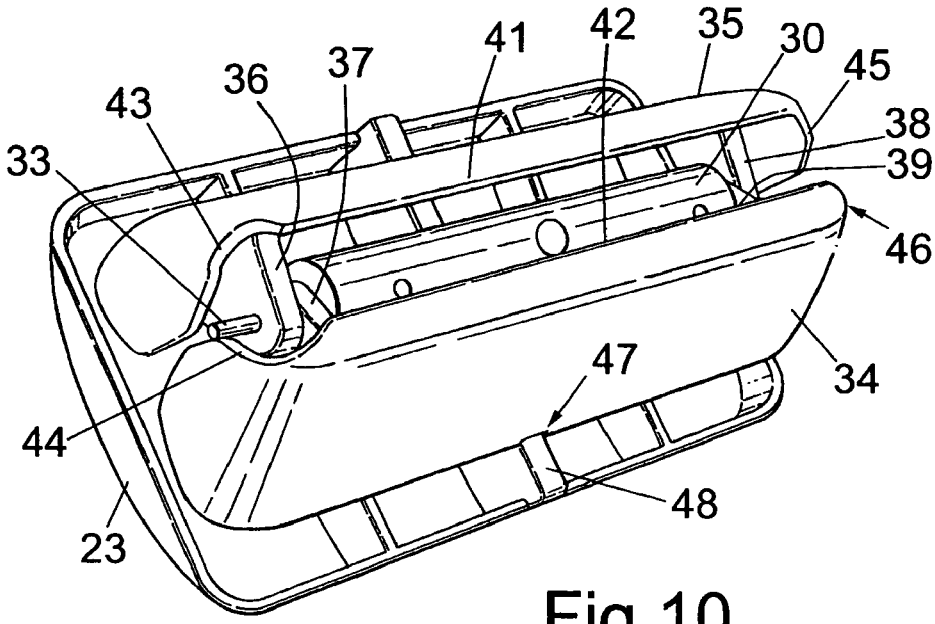
FIG. 10 is a perspective view of the mop head of the first embodiment of the present invention showing the jaws in the open configuration.

It can thus be seen from FIGS. 5, 6 and 10 that the spring 28 acts as a spring against which work must be done by the operation of the handle 9 in order to slide the mop head housing 23 upwards along the shaft 3, and the jaw spring 40 acts to ensure that the jaw members 34 and 35 are urged open when the mop head housing 23 moves away from the jaw pivots 33 as shown in FIG. 6.

Figure 7:
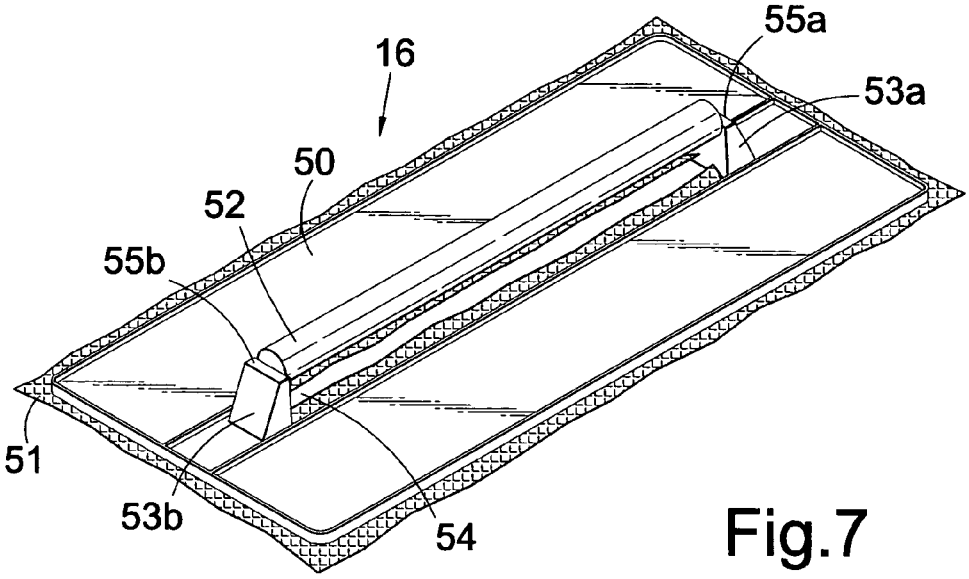
FIG. 7 is a perspective diagram of the cleaning member in accordance with the first embodiment of the present invention.
Figure 8:
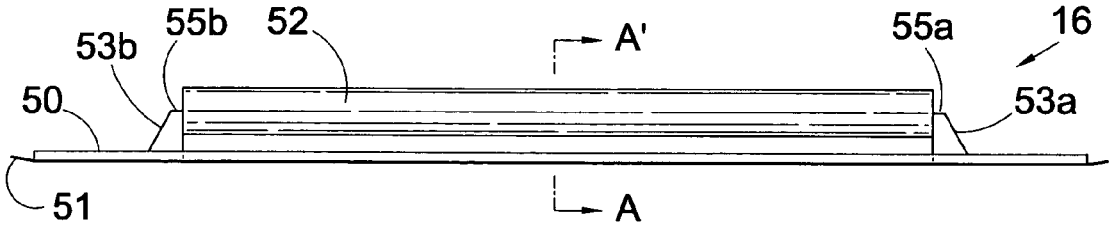
FIG. 8 is a side view of the cleaning member in accordance with the first embodiment of the present invention.
Figure 9:
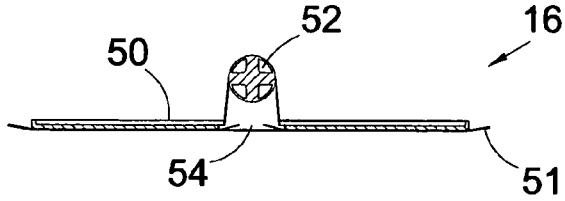
FIG. 9 is a sectional view through the section AA' in FIG. 8.

The cleaning element 16 will now be described with reference to FIGS. 7 to 9.

The cleaning element 16 comprises a substantially rigid panel 50. The panel in this embodiment is made of a plastics material. The panel 50 is rectangular in shape to provide the common shape used for mop surfaces. The panel 50 has a cleaning layer 51 applied to one side thereof. The cleaning layer 51 extends beyond the periphery of the panel 50. The reason for this is that this extended region of the cleaning layer 51 enables crevices to be reached to provide better cleaning. The cleaning layer 51 can comprise any suitable absorbent material such as a fibrous material or a sponge-like material. The cleaning layer 51 can comprise any suitable cleaning material for performing a requisite cleaning job. The material can be impregnated with any suitable cleaning substance. The substance can be a detergent solution and can, for example, include bleach.

On a second side of the panel 50 there is provided an engagement member formed as a cylindrical rod 52 extending along a central portion of the panel 50 and held at its ends by mounts 53*a* and 53*b*. The rod 52 is held by the mounts 53*a* and 53*b* to extend from the panel 50 to provide a space between the rod 52 and the panel 50. This enables the jaw edges 41 and 42 of the jaw members 34 and 35 to extend underneath the rod 52 (i.e. between the rod 52 and the panel 50) and when clamp mechanism engages the engagement member of the panel 16. The rod 52 is longer than the jaw edges 41 and 42 of the jaw members 34 and 35 such that the rod 52 extends through the cut-away portions 43 to 46 of the jaw members 34 and 35.

The panel 50 is also provided with a cut-away portion 54 directly underneath the rod 52. The cut-away portion 54 is of sufficient size to receive a rod 52 of another cleaning element 16. The rod 52 of the cleaning element 16 is mounted on the mounts 53*a* and 53*b* such that when the cleaning elements 16 are stacked one upon the other, the rod 52 of a cleaning element extends into the cut-away portion 54 of another cleaning element 16 so that the cleaning layer 51 on the panel 50 at the ends of the cut-away portions 54 of one cleaning element 16 rest on top faces 55*a* and 55*b* of respective mounts 53*a* and 53*b*. This provision of the cut-away portion 54 which can receive a rod 52 of another cleaning element 16 enables the more compact stacking of cleaning elements 16 in the cartridge 15. This is illustrated in FIG. 4.

Figure 11:
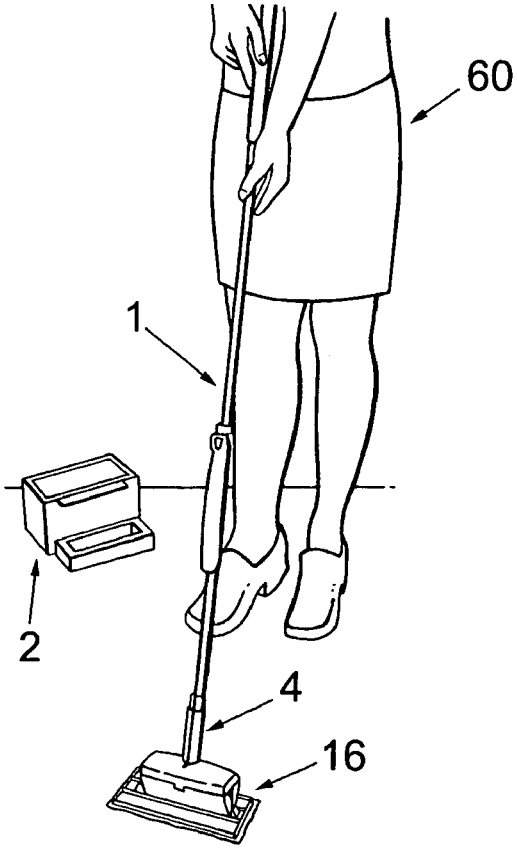
FIG. 11 is a diagram illustrating the mop construction of the first embodiment of the present invention in use.
Figure 12:
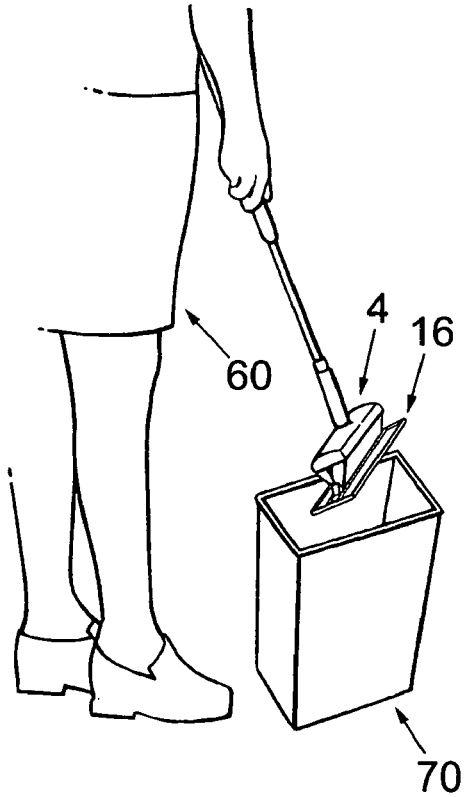
FIG. 12 is a diagram illustrating the method of disposal of the cleaning member in accordance with the first embodiment of the present invention.

The provision of the engagement member of the cleaning element 16 as a rod 52 in this embodiment of the present invention enables the jaw members 34 and 35 of the clamp mechanism to slide over the face of the rod 52 thereby allowing the cleaning element 16 to pivot relative to the mop head 4, i.e. to pivot about an axis provided by the rod 52. Thus in use as shown in FIG. 11, as the mop handle 1 is moved to and away from a user 60 the cleaning element 16 is able to remain contacted to the cleaning surface which in this case comprises the floor.

It can thus be seen that this embodiment of the present invention provides for a convenient mop construction in which during non-use disposable cleaning elements can be stored within a mop housing 2 within a cartridge 15 ready for use and stored so that they do not lose their cleaning effectiveness, e.g. by drying out. A mop handle 1 is mounted within the housing 2 using the clamp mechanism. When a user 60 wishes to perform a cleaning function using the mop construction, a user disengages the mop handle 1 from the mop housing 2 by using the handle 9 to operate the clamp mechanism to release the mop handle 1 from the mop stand 10. The lid 12 of the container 11 is then opened and the mop handle extended into the cartridge 15. The handle 9 is operated to open the clamp mechanism to engage the engagement member of the cleaning element 16 at the top of the stack within the cartridge 15. A complete mop with a fresh cleaning element is thus arrived at by the attachment of the fresh cleaning element 16 to the mop head 4. Once the cleaning operation is finished or the mop head is considered dirty, a user is able to automatically separate the soiled cleaning element 16 from the mop handle 1 by operating the handle 9 in a lever-type action whilst holding the mop head 4 holding the dirty cleaning element 16 over a disposal receptacle 70. In this way a user is able to remove a cleaning element from the mop without having to come into contact with the mop and without having to handle volumes of dirty liquid as with a traditional wet mop having a fibre absorptive rope head.

A second embodiment of the present invention will now be described with reference to FIGS. 13 and 14.

This embodiment of the present invention provides for the relative rotation of a mop handle 100 and a cleaning element 101 about any axis perpendicular to a shaft 102 of the mop handle 100. In other words, the cleaning element 101 can rotate around a pivot point relative to a first end of the mop handle 100.

The general construction of the mop handle 100 and the cleaning element 101 is similar to the first embodiment of the present invention apart from the clamp mechanism 103 of the mop head 104 and the engagement member 105 of the cleaning element 101. Thus the description of this embodiment of the present invention will be limited to only these different features.

Figure 13:
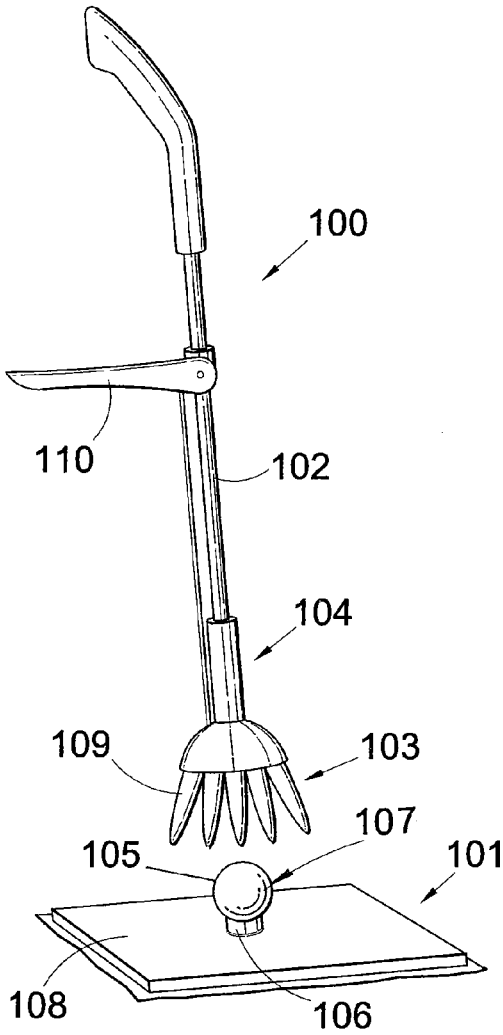
FIG. 13 is a diagram of a mop construction in accordance with a second embodiment of the present invention showing the clamp mechanism disengaged from the cleaning member.

FIG. 13 illustrates an embodiment of the present invention. With reference to FIG. 13, the clamp mechanism 103 is in the open state and disengaged from the engagement member 105. The engagement member 105 comprises a neck 106 extending from a side of the panel 108 of the cleaning element 101. The neck 106 is connected at one end to the panel 108 and at the other end it supports a head of spherical-like shape. The surface of the head 107 is arranged to provide a curved surface for engagement by the clamp mechanism 103 of the mop handle 100. The head 107 need not be completely spherical. Only the side regions of the head 107 need to provide the curved surface to allow the clamp mechanism 103 to slide thereover.

The clamp mechanism 103 comprises a plurality of petal-like members 109 which are shaped like segments of the surface of a sphere. The clamp mechanism 103 is arranged to operate when the handle 110 is operated to open the elements 109 like multiple jaws to open up a socket-like clamping arrangement for clamping the engagement member 105.

Figure 14:
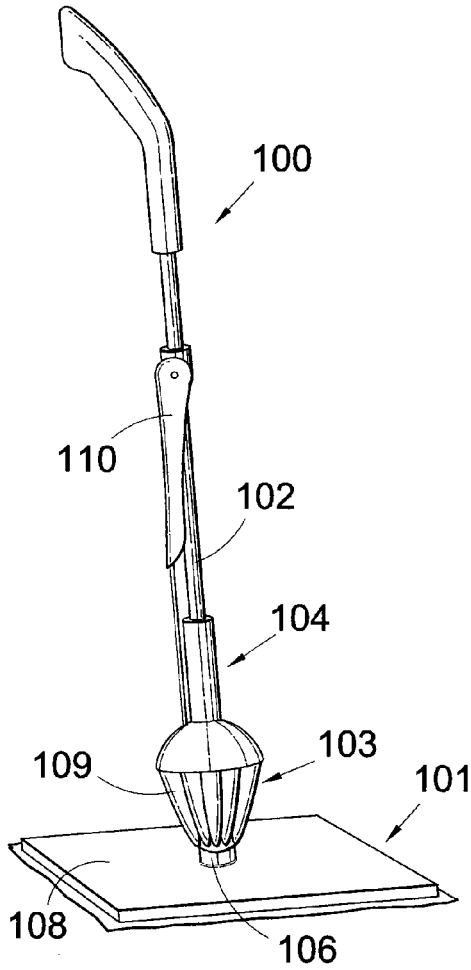
FIG. 14 is a diagram of the mop construction in accordance with the second embodiment of the present invention showing the clamp mechanism engaged with the cleaning member.

FIG. 14 illustrates the mop construction of this embodiment of the present invention in which the clamp mechanism 103 is engaged to the engagement member 105 to provide a ball-and-socket-type joint to allow the cleaning element 101 to rotate relative to the mop handle 100 about a pivot point within the clamp mechanism 103.

This embodiment of the present invention provides an arrangement in which the rotation of the cleaning element 101 relative to the mop handle 100 is not restricted to a single axis perpendicular to the shaft of the mop handle 100. This provides a versatile mop construction at the expense of a more complex clamp mechanism.

The mop construction in accordance with the present invention can be used as a wet or dry mop and is suitable for mopping and dusting. The use of a disposable cleaning member rather than conventional cleaning sheets provides for a simpler method of operation and for a more convenient and less messy method of cleaning. The present invention avoids the necessity for a user to handle a cleaning element or cleaning sheet and also avoids the necessity for a user to handle cleaning liquid, e.g. a bucket of water containing detergent. Thus the present invention provides a convenient and hygienic arrangement for cleaning.

Although the present invention has been described hereinabove with reference to specific embodiments, it will be apparent to a skilled person in the art that modifications lie within the spirit and scope of the present invention.

The invention claimed is:

1. A mop construction comprising:

an elongate shaft having a first and a second end;

a mop head located on said first end of said shaft, said mop head having a mop head housing and a clamp mechanism, said clamp mechanism has a first spring which is biased to urge said clamp mechanism open, and said mop head housing is operable to abut said clamp mechanism;

a second spring at said shaft, said second spring is operable to abut said mop head housing, said second spring is biased to push on said mop head housing, so that said mop head housing pushes on said clamp mechanism to urge said clamp mechanism closed;

a substantially rigid cleaning member clampable by said clamp mechanism when it is urged closed;

said cleaning member comprising a panel having opposite first and second sides, an engagement member located on said first side of said panel for being engaged and clamped by said clamp mechanism of said mop handle, a cleaning layer located on said second side of said panel; and an operating arrangement connected to said mop head housing and operable on said mop head housing to enable said first spring to open said clamp mechanism to enable said engagement member of said cleaning member to automatically separate from said clamp mechanism and also operable on said mop head housing to enable said second spring to operate said mop head housing to push on and urge said clamp mechanism closed.

2. A mop construction according to claim 1, wherein said clamp mechanism comprises at least one clamp member which is operable by said mop head to rotate about an axis across an axis of said shaft.

3. A mop construction according to claim 1, wherein said clamp mechanism comprises first and second relatively moveable clamp members forming jaws.

4. A mop construction according to claim 3 wherein said engagement member is elongate substantially perpendicular to said shaft, and said first and second clamp members extend substantially perpendicular to said shaft for engagement with said elongate engagement member of said cleaning member.

5. A mop construction according to claim 4, wherein said jaws include an opening at each end thereof to allow said engagement member of said cleaning member to extend therethrough.

6. A mop construction according to claim 4, wherein said panel is elongate and said engagement member extends along said first side of said panel.

7. A mop construction according to claim 6, wherein said engagement member comprises a substantially cylindrical rod.

8. A mop construction according to claim 7, wherein said engagement member extends from said first side of said panel.

9. A mop construction accordingly to claim 3, wherein said operating arrangement is operable against said bias of said second spring to permit said jaws to open apart under the bias of said first spring.

10. A mop construction according to claim 1, wherein said clamp mechanism forms a socket joint for receiving an engagement member of said cleaning member to allow relative rotation of said cleaning member and said mop handle.

11. A mop construction according to claim 1, wherein said operating arrangement is mounted on said shaft at a position intermediate said first end and said second end.

12. A mop construction according to claim 11, wherein said operating arrangement comprises an operating lever pivotable between positions thereof with respect to said shaft for operating on said mop head.

13. A mop construction according to claim 1, wherein said engagement member has a curved surface for engagement by said clamp mechanism to allow said clamp mechanism to slide over said surface to allow relative rotation of said handle and said cleaning member.

14. A mop construction according to claim 1, wherein said engagement member comprises a nodule protruding from said first side of said panel for engagement by said clamp mechanism in the form of a socket joint to allow the relative rotation of said cleaning member and said mop handle.

15. A mop construction according to claim 1, wherein said cleaning layer comprises a compliant layer of absorbent material which extends beyond the boundaries of said second side of said panel.

16. A mop construction according to claim 1, wherein said panel is substantially rigid to spread a force applied by said mop handle to said first side of said panel across said panel so as to apply even pressure across said second side of said panel to a surface being mopped.

17. A mop construction according to claim 1, including a cleaning member cartridge containing a stacked plurality of said cleaning members, said cleaning member cartridge having an opening through which said mop head can be projected for engagement of said clamp mechanism with a said cleaning member at the top of the stack.

18. A mop construction according to claim 1, wherein said operating arrangement comprises a handle coupled to said shaft;

a cable coupled to said handle and to said mop head housing wherein operating said handle moves said mop head housing.

19. A mop construction according to claim 18, wherein when said handle has a first orientation relative to said shaft, said cable is pulled for moving said mop head housing against said bias of said second spring for allowing said first spring in said clamp mechanism to open said clamp mechanism.

20. A mop construction according to claim 1, wherein said first spring exerts a stronger bias on said clamp mechanism than said second spring.

* * * * *